US005179769A

United States Patent [19]

Ferguson, Sr. et al.

[11] Patent Number: 5,179,769

[45] Date of Patent: Jan. 19, 1993

[54] VISION SYSTEM FOR BOBBIN STRIPPING

[75] Inventors: John H. Ferguson, Sr., P.O. Box 116, Linwood, N.C. 27299; James D. Heiss, Lexington, N.C.

[73] Assignee: John H. Ferguson, Sr., Linwood, N.C.

[21] Appl. No.: 761,726

[22] Filed: Sep. 18, 1991

[51] Int. Cl.[5] ..... B65H 73/00

[52] U.S. Cl. ..... 28/292; 28/294

[58] Field of Search ..... 28/294, 292, 295, 297, 28/293, 185, 186, 187; 139/237

[56] References Cited

U.S. PATENT DOCUMENTS

| | | | |
|---|---|---|---|
| 2,634,489 | 4/1953 | Root, III | 28/19 |
| 2,737,852 | 3/1956 | Porter | 88/98 |
| 3,640,163 | 2/1972 | Giardini et al. | 28/295 X |
| 3,879,742 | 4/1975 | Smith | 354/64 |
| 4,280,137 | 7/1981 | Ashida et al. | 358/101 |
| 4,536,064 | 8/1985 | Schindel et al. | 350/583 |
| 4,670,953 | 6/1987 | Kanda et al. | 28/185 |
| 4,765,043 | 8/1988 | Yamashita | 28/294 |
| 4,965,917 | 10/1990 | Ferguson | 28/295 |
| 5,018,936 | 5/1991 | Izumi et al. | 414/752 |

*Primary Examiner*—Werner H. Schroeder
*Assistant Examiner*—Bibhu Mohanty
*Attorney, Agent, or Firm*—Rhodes, Coats & Bennett

[57] ABSTRACT

Apparatus for assuring complete stripping of fibers from a bobbin in a bobbin stripping system includes a bobbin stripping station including oscillating water jets, a viewer to view bobbins as they are being stripped at the stripping station and to generate signals representative of a bobbin being stripped. A water jet position sensor generates a signal indicative of whether the position of the water jets is such that the viewer's view of the bobbin is unobscured. An indexing conveyor moves fully stripped bobbins from the stripping station and unstripped bobbins to the bobbin stripping station. A bobbin transport sensor generates a signal when the indexing conveyor is moving a bobbin to or from the bobbin stripping station. A computation device selects pixels of the signals from the viewer, counts a first number of pixels indicative of fibers and a second number of pixels indicative of bobbin. It compares the first and second numbers to preset values to determine the amount of fibers still unstripped from a bobbin and when the bobbin is fully stripped of fibers outputs a signal to the indexing conveyor to move the stripped bobbin from the stripping station and to move an unstripped bobbin to the bobbin stripping station.

37 Claims, 2 Drawing Sheets

VISION SYSTEM FOR BOBBIN STRIPPING

BACKGROUND OF THE INVENTION

The present invention relates to vision systems for bobbin stripping systems and for other automation applications, such as robotics. It is particularly useful for stripping fiberglass yarn from the dark colored bobbins used in fiberglass yarn processing.

U.S. Pat. No. 4,965,917 discloses an apparatus for use in stripping yarn from bobbins. The entire disclosure of that patent is incorporated herein by reference. Briefly, that patent discloses an apparatus including a conveyor for conveying bobbins to be stripped to a stripping station. The bobbins stop at the stripping station at which are located a plurality of vertically aligned nozzles which emit high pressure water streams. The nozzles are mounted for pivoting reciprocation about axes generally parallel with the line of travel of the conveyor. The axes are spaced from one another vertically, so that as the various nozzles reciprocate through their respective arcs, high pressure water jets are directed against the bobbin along a generally vertically extending line. The jets shear the fiberglass and wash it away, leaving a relatively clean bobbin.

The number of reciprocations of the nozzles needed to completely strip the yarn from a bobbin varies, depending upon numerous variables, including the amount of yarn still adhering to the bobbin, the dirtiness of the bobbin, the condition of the bobbin, and the operating performance of the nozzles. In the prior apparatus the conveyor carried the bobbins past the stripping station, where they were held stationary for a preset period of time for stripping. It was found that in order to assure a high level of confidence that the bobbins have been completely stripped, an inordinately long stripping period must be provided for each bobbin. That is, the preset stripping period must be long enough to strip the bobbins needing the longest period for stripping. This results is inefficient operation when stripping bobbins which do not require such long stripping periods. Setting the period to be too short results in an excessive number of bobbins not being completely stripped, requiring reworking.

One possible solution to this would be to have an operator manually watch each bobbin be stripped and actuate a switch to index the conveyor holding the bobbins when the human operator can visually detect complete stripping. While this is a theoretically feasible approach, the expense of using a human operator for such a job is undesirable. Also, this would be a very tedious job for a person to carry out. Furthermore, the environment in which the stripping takes place is subject to high pressure water sprays and flying fragments of glass yarn. The water spray forms vision-obscuring mists, so the operator may have difficulty seeing the bobbin. Adding the fact that the operator may suffer injury from the glass yarn particles makes this choice of a solution undersirable.

Accordingly, there is a need in the art for a method and apparatus for automating the stripping apparatus to assure efficient and complete stripping of the bobbins. Furthermore, there is a need for a vision system for processes of this sort to allow the vision system to operate, even in the presence of vision-obscuring by-products.

SUMMARY OF THE INVENTION

The present invention fulfills this need by providing apparatus for assuring complete stripping of fibers from a bobbin in a bobbin stripping system. It includes a bobbin stripping station, and a viewer to view bobbins as they are being stripped at the stripping station and to generate signals representative of a bobbin being stripped. A computation means evaluates the signals to determine the amount of fibers still unstripped from a bobbin and to generate a signal indicative that the bobbin is fully stripped of fibers. A bobbin transport moves a fully stripped bobbin from the stripping station and an unstripped bobbin into the bobbin stripping station in response to the computations means's generation of the signal indicative of the bobbin being fully stripped. Preferably, the viewer is a television camera. Also, preferably, the computation means is a personal computer. The bobbin transport is desirably an indexing conveyor.

In a preferred embodiment the bobbin stripping station uses oscillating water jets and a water jet position sensor generates a signal indicative that the position of the water jets is such that the viewer's view of the bobbin is unobscured. Then, the computation means can evaluate the signals from the viewer when the signals from the water jet position sensor indicate that the viewer's view of the bobbin is unobscured.

Also in a preferred embodiment the computation means selects pixels from the signals supplied by the viewer for evaluation. Desirably, the computation means counts a first number of pixels indicative of fibers and a second number of pixels indicative of bobbin. Then, the computation means compares the first and second numbers to preset values and generates the signal that the bobbin is fully stripped when the first number is less than a first preset and the second number exceeds a second preset.

Alternatively, the computation means may select pixels from the signals supplied by the viewer for evaluation, count a number of pixels indicative of bobbin, compare the number to a preset value, and generate the signal that the bobbin is fully stripped when the number exceeds the preset value.

Preferably, the apparatus includes a bobbin transport sensor to generate a signal that a bobbin is not in transit to or from the bobbin stripping station, and the computation means outputs a signal to the bobbin transport only at times when the bobbin transport sensor generates this signal. For example, the computation means may evaluate signals from the viewer only when the transport sensor generates the signal that a bobbin is not in transit. In one embodiment the bobbin transport sensor includes a flip-flop set when bobbin stripping is complete so that the completely stripped bobbin may be transported from the bobbin stripping station and reset upon arrival of an unstripped bobbin at the bobbin stripping station.

The invention also provides a method of assuring complete stripping of fibers from a bobbin in a bobbin stripping system including stripping fibers from a bobbin, viewing a bobbin as it is being stripped and generating signals representative of the bobbin being stripped. Then, the signals are evaluated to determine the amount of fibers fill unstripped from a bobbin. When the bobbin is fully stripped of fibers, a signal is generated, and the fully stripped bobbin is transported from a stripping location and replaced by an unstripped bobbin in response to the generation of the signal indicative of the bobbin being fully stripped. Preferably, the viewing step includes viewing with a television camera. Also preferred is for the evaluating step to be performed in a personal computer. In a preferred embodiment the transporting step includes indexing a conveyor.

In one embodiment the bobbin stripping step includes oscillating a water jet and the method further includes sensing the position of the water jet and generating a signal indicative that the position of the water jet is such that the view of the bobbin is unobscured by the water jet. The evaluating step occurs when the signals from the water jet position sensing step indicate that the view of the bobbin is unobscured.

The evaluating step preferably includes selecting pixels from the signals supplied by the viewing step for evaluation. Desirably, this step includes counting a first number of pixels indicative of fibers and a second number of pixels indicative of the bobbin. This is followed by comparing the first and second numbers to preset values and generating the signal that the bobbin is fully stripped when the first number is less than a first preset and the second number exceeds a second preset. Alternatively, the evaluating step may include selecting pixels from the signals supplied by the viewing step for evaluation, counting a number of pixels indicative of bobbin, comparing the number to a preset value, and generating the signal that the bobbin is fully stripped when the number exceeds the preset value.

Desirably, the method includes sensing whether or not a bobbin is in transit to or from the bobbin stripping location, and the evaluating step occurs only at times when the sensing step indicates that a bobbin in not in transit.

The invention further provides a vision system for automating a process which scatters vision-obscuring by-products including apparatus carrying out the process and scattering vision obscuring by-products, a viewer directed at the apparatus, and control means operatively interposed between the viewer and the apparatus to control the apparatus in response to data about the apparatus received by the viewer. A rotating transparent shield is interposed between the apparatus and the viewer to centrifugally throw off by-products scattered onto the shield to provide the viewer a clear, shielded view of the apparatus. Desirably, the viewer is selected from the group consisting of a television camera, a charge coupled device, and a photocell. Preferably, the viewer has a line of sight, the rotating transparent shield includes a motor mounted to have a driven axis of rotation substantially parallel to the line of sight, and a plexiglass disk is mounted to the axis of the motor. In an exemplary embodiment the apparatus is a bobbin stripper.

The invention further provides a method of automating a process which scatters vision-obscuring by-products including carrying out the process and thereby scattering vision obscuring by-products, viewing the process as it is carried out from a viewing location, controlling the process in response to data about the process received in the viewing step, and rotating a transparent shield located between the process and the viewing location to centrifugally throw off by-product scattered onto the shield, to provide a clear, shielded view of the process. Where the viewing location defines a line of sight with the viewed process, the rotating step may include rotating the transparent shield on an axis of rotation substantially parallel to the line of sight. In an exemplary embodiment the process includes stripping fibers from bobbins with water jets.

BRIEF DESCRIPTION OF THE DRAWINGS

The invention will be better understood from a reading of the detailed description of the preferred embodiments along with a study of the drawings in which.

DETAILED DESCRIPTION OF THE PREFERRED EMBODIMENT

Figure 1:
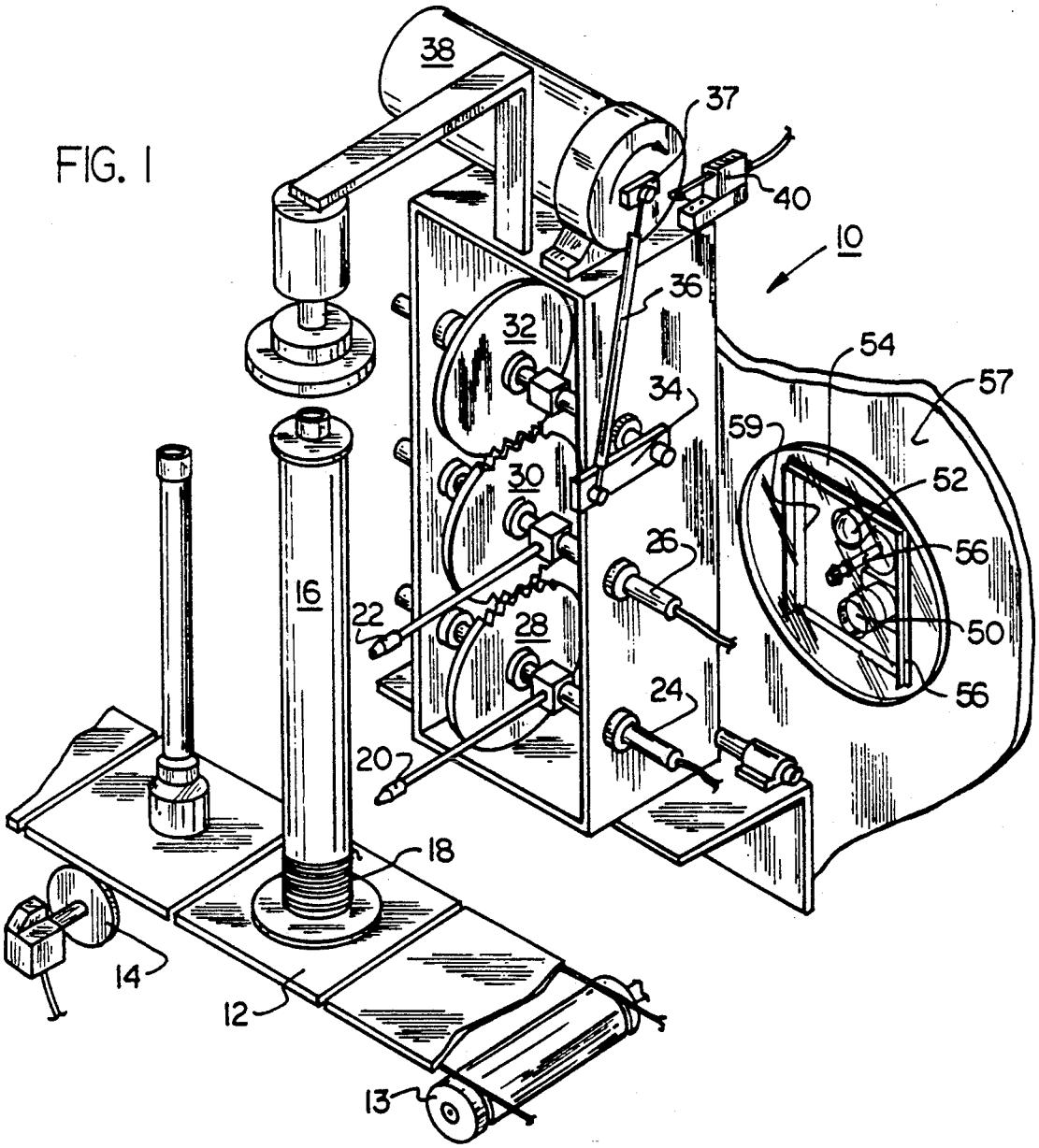
FIG. 1 is a perspective view of pertinent apparatus according to an embodiment of the invention.

As mentioned above, the present invention relates to an improvement in the apparatus disclosed in my prior U.S. Pat. No. 4, 965,917, the disclosure of which is incorporated herein by reference. FIG. 1 of the present application corresponds in many respects with FIG. 13 of the prior patent, and the components depicted in connection with that FIG. 13 are suitable for use in connection with the present invention.

The apparatus 10 includes an indexing conveyor line 12 driven by an indexing motor, depicted as stepping motor 13. Other arrangements to index the conveyor a preset distance can be substituted, as will be apparent to those of ordinary skill in the art. A sensor 14 is provided to generate an electrical signal indicative that the conveyor line 12 is in motion or not. A bobbin 16 having residual yarn 18 thereon is mounted on the conveyor line 12 and depicted in FIG. 1 as being in position for stripping by the apparatus. The yarn and bobbin are desirably of contrasting colors. Typically, in the fiberglass yarn industry, yarn 18 is a translucent white and the bobbin 16 is black or dark blue, providing strong light/dark contrasts (The term "bobbin" as used herein should be broadly construed as including yarn package holders of all types including quills, spools, and the like. Similarly, the use of the terms "yarn" and "fibers" herein should each be broadly construed as including various textile strand types including rovings and the like.)

The apparatus includes a plurality of nozzles 20,22 supplied with high pressure water through supply lines 24,26, respectively. The nozzles are mounted for pivoting movement by being rigidly mounted to disk/gears 28,30. The disk/gears 28,30 are enmeshed with one another, along with a third disk/gear 32. Reciprocal arcuate turns of the disk/gear 32 result in corresponding arcuate pivoting of the nozzles 20,22. In the prior patent, disk/gear 32 was shown as also being provided with a nozzle, but it has been found in practice not to be necessary, particularly for shorter bobbins.

The disk/gear 32 is mounted for rotation by a crank arm 34, which is in turn caused to reciprocally pivot by the vertical oscillation of push-rod 36. Push rod 36 is rotatably mounted on eccentric 37 of motor 38. A switch 40 acts as a nozzle position sensor by actuation by the eccentric 37, each cycle of the motor 38. That is, the nozzle position sensor switch 40 is located so as to be closed every time the nozzles 20,22 are driven apart by the motor 38 and the linkage through eccentric 37, push rod 36, crank arm 34 and disk/gears 28,30, 32.

Laterally of the nozzles, a black and white television camera 50 is positioned, along with a light source 52 to illuminate the yarn 18 on bobbin 16. The TV camera 50 is directed and focused on the bobbin 16 to generate visual signals of the bobbin 16 and the yarn 18, thereby providing data as to how much yarn remains on the bobbin. Adjacent the TV camera 50, a motor 56 has mounted to it a plexiglass disk 54 for high speed rotation. The TV camera 50 and motor 56 are mounted behind a wall 57 so that the camera 50 looks through a window 59 in the wall. A spacer 56 may be mounted around the outside of the window 56 to make the clearance between the plexiglass disk 54 and the spacer 56 as small as possible to minimize the introduction of water and fiber to the area of the TV camera. The light source 52 is shown being behind the plexiglass disk 54, but could just as well be forward of the wall 57. Its precise placement is not significant, as long as it illuminates the bobbin and yarn adequately for the camera 50.

Figure 3:
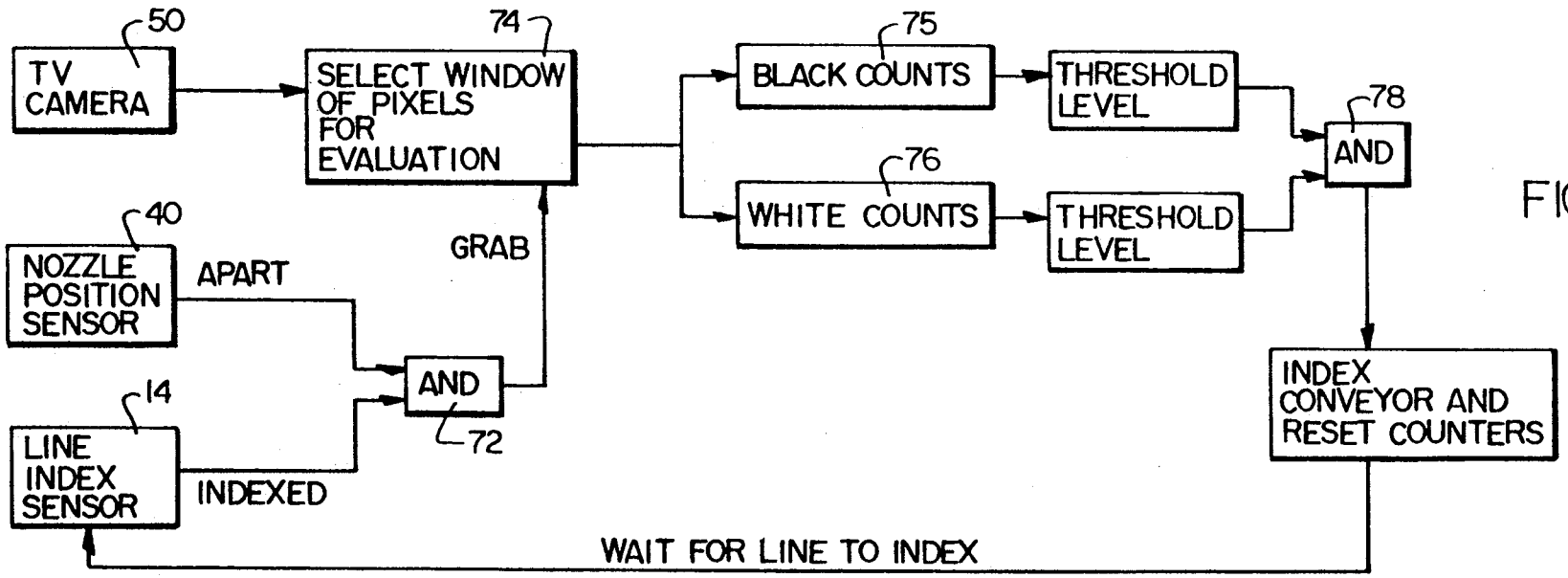
FIG. 3 is a block diagram of a flow chart of the operation of the embodiment of FIG. 1.
Figure 2:
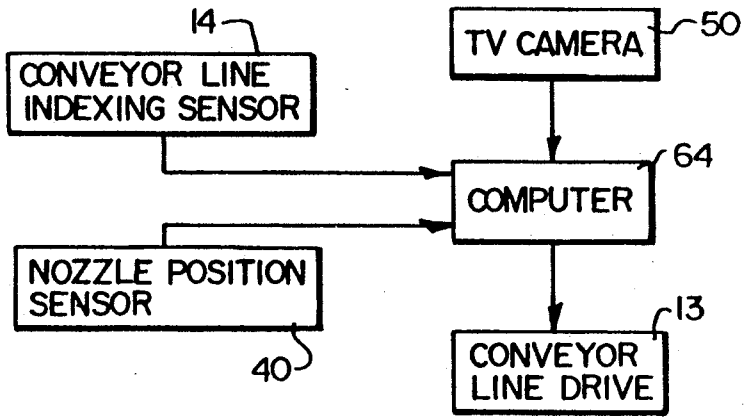
FIG. 2 is a block diagram of hardware elements of the embodiment of FIG. 1.

The signals from the TV camera 50, nozzle position sensor 40, and conveyor line indexing sensor 14 are all applied as shown in FIG. 2 to a personal computer 64. It has an output to the conveyor indexing drive motor 13. These data are evaluated in the computer 64 in accordance with the logic flow charted in FIG. 3.

When the index sensor 14 signals that the conveyor line is not in motion (therefore indicative that a bobbin is in position in front of the nozzles) and the nozzle position sensor 40 signals that the nozzles are spread apart (therefore indicative that the TV camera 50 has a clear view of the bobbin), this occurrence is recognized in an AND gate circuit 72. The receipt of the AND signal is then used by the computer to freeze a frame of the image from TV camera 50. The number of data points in the selected frame is then reduced by selecting a windown of pixels within the entire frame indicative of the position of the bobbin and yarn. The indexing conveyor always positions the bobbin in the same place in front of the nozzles, so the TV image always has the pixels caused by the bobbin and yarn to be the same ones in the frame. If the indexing conveyor is less accurate, or the TV camera is subject to being moved out of position, this step can be omitted. However, by reducing the amount of the TV image to be evaluated, the reliability of the data increases and the speed of the operation increases. The programming techniques to select the pixels of interest are readily apparent to those of ordinary skill in the art.

The black ones of the selected pixels are counted in register 75 to indicate the amount of bobbin seen by the TV camera and the white ones are counted in register 76 to indicate the amount of yarn seen by the TV camera. The computer compares the number of black pixels and the number of white pixels with preset threshold levels. A completely stripped bobbin will register a certain minimum number of black pixels and a certain maximum level of white pixels. When the counted black and white pixels reach their respective levels simultaneously, the computer concludes that the bobbin in completely stripped. This simultaneous occurrence is noted in AND-gate 78. When this occurs, an instruction is output to index the conveyor by activating motor 13. The motor 13 will then drive the conveyor one position to move the completely stripped bobbin out of the stripping station and move a new bobbin to be stripped into the stripping station. The actuation of AND-gate 78 also resets the black and white registers 75,76 to zero for the next frame to be evaluated. The indexing of the conveyor by actuation of motor 13 causes the signal from the line index sensor 14 to be negative, to inhibit the output of a signal from the AND-gate 72. When indexing is completed, that signal again goes high so that when the nozzle position sensor 40 next indicates that the nozzles are apart, the AND-gate 72 will enable the computer 64 to select another window of pixels from the TV camera 50 for evaluation, and the cycle resumes.

If the black and white counts do not reach their respective threshold levels, no signal is sent to index the conveyor so that the signal out of the line index sensor 14 stays high. Thus, each time that the nozzle position sensor 40 indicates that the nozzles are apart, a window of pixels will be selected for evaluation, until the black and white counts reach their respective threshold levels. When the completed black and white pixel counting indicates that the bobbin is not completely stripped, the registers 75 and 76 are still reset to zero, so that the evaluation of the next frame of data from the camera 50 about the bobbin at the stripping station starts from zero.

If desired, the circuit can require that the black and white counts reach their respective threshold levels two times in succession before indexing the conveyor, in order to provide a higher level of assurance that the bobbin in completely stripped before indexing. The threshold levels may be set as desired to accommodate different yarn and bobbin sizes and colors.

If desired, the computer may be programmed to count only the black pixels or only the white pixels and to compare the count with an appropriate threshold. This has the advantage of requiring less computing power, at the sacrifice of some reliability.

The high speed rotation of the plexiglass disk 54 in front of the camera 50 assures that the water emanating from nozzles 20,22 and yarn pieces 18 from the bobbin which tend to fly all over in the stripping process do not obscure the vision of the TV camera. Water and fibers which impact on the plexiglass disk 54 are thrown radially outward by the high speed rotation of the disk, so the disk stays clear and provides the camera 50 with a clear view of the bobbin. This apparatus for assuring a viewer (i.e. such as a TV camera, a charge coupled device or photocell) a clear view of a process to be inspected can be used in various industrial processes which generate vision-obscuring by-products, in addition to bobbin stripping with high pressure water.

In operation, the indexing conveyor 12 brings a new bobbin 16 into position in the stripping station. The yarn 18 is stripped from the bobbin by the high pressure water from nozzles 20,22, which reciprocate vertically. They are driven so as to alternately be apart and together. When they are apart, as indicated by the nozzle position sensor 40, and the conveyor line is stationary, as indicated by the sensor 14, the TV camera 50 "grabs" a frame of data of the bobbin yarn. The computer then "looks at" only those portions of the TV signal which are indicative of the location of the bobbin and yarn and counts the black and white levels in that portion of the picture. When the black portion is high enough and the white portion is low enough, a decision is made that the bobbin is completely stripped. The computer therefore outputs a signal to the motor 13 to index the indexing conveyor line 12 to take the completely stripped bobbin out of the stripping station and move a new bobbin into position. The movement of the conveyor line disables the vision system because the line index sensor 14 signals that there is no bobbin in position at the stripping station. The vision system is again re-enabled when the conveyor stops and the nozzles 20,22 are spread apart so that the TV camera 50 gets a good view of the bobbin to allow a meaningful frame of data to be "grabbed".

If the computer decides that the bobbin is not completely stripped, it resets in black and white counters to zero, grabs another frame of data the next time the nozzles are apart and makes the same evaluation. It continues to do so until it reaches a decision that the bobbin is completely stripped. If desired, an override program may be included to count the number of iterations of this process for each bobbin and index the conveyor anyway in the rare event that a bobbin is not completely stripped after a preset number of evaluations.

Also, if the computer cannot complete the pixel selection and counting steps during the period between signals from the sensor 40, a third condition can be applied to the AND-gate 72. This condition would be indicative that the pixel selection and counting are not completed and would inhibit the selection of another frame of data before the last selected frame has been evaluated.

The line index sensor, also referred to herein as a bobbin transport sensor, may include a flip-flop set when bobbin stripping is complete so that the completely stripped bobbin may by transported from the bobbin stripping station and reset upon arrival of an unstripped bobbin at the bobbin stripping station.

Various other modifications to the invention will become apparent to those of ordinary skill in the art and these are to be deemed to be within the scope of this invention.

What is claimed is:

1. Apparatus for assuring complete of fibers from a bobbin in a bobbin stripping system comprising a bobbin stripping station, a viewer to view bobbins as they are being stripped at said stripping station and to generate signals representative of a bobbin being stripped, computation means to evaluate the signals to determine the amount of fibers still unstripped from a bobbin and to generate a signal indicative that the bobbin is fully stripped of fibers, and a bobbin transport to move a fully stripped bobbin from said stripping station and to move an unstripped bobbin into said bobbin stripping station in response to said computations means's generation of said signal indicative of the bobbin being fully stripped.

2. Apparatus as claimed in claim 1 wherein said viewer is a television camera.

3. Apparatus as claimed in claim 1 wherein said computation means is a personal computer.

4. Apparatus as claimed in claim 1 wherein said bobbin transport is an indexing conveyor.

5. Apparatus as claimed in claim 1 wherein said bobbin stripping station uses oscillating water jets and further comprising a water jet position sensor which generates a signal indicative that the position of said water jets is such that said viewer's view of the bobbin is unobscured.

6. Apparatus as claimed in claim 5 wherein said computation means evaluates the signals from the viewer when the signals from said water jet position sensor indicate that said viewer's view of the bobbin is unobscured.

7. Apparatus as claimed in claim 1 wherein said computation means selects pixels from the signals supplied by said viewer for evaluation.

8. Apparatus as claimed in claim 7 wherein said computation means counts a first number of pixels indicative of fibers and a second number of pixels indicative of bobbin.

9. Apparatus as claimed in claim 8 wherein said computation means compares said first and second numbers to preset values and generates said signal that the bobbin is fully stripped when the first number is less than a first preset and the second number exceeds a second preset.

10. Apparatus as claimed in claim 1 wherein said computation means selects pixels from the signals supplied by said viewer for evaluation, counts a first number of pixels indicative of fibers, and compares said first numbers to a first preset value and generates said signal that the bobbin in fully stripped when the first number is less than the first preset value.

11. Apparatus as claimed in claim 1 wherein said computation means selects pixels from the signals supplied by said viewer for evaluation, counts a number of pixels indicative of bobbin, and compares said number to a preset value and generates said signal that the bobbin is fully stripped when the number exceeds the preset value.

12. Apparatus as claimed in claim 1 further comprising a bobbin transport sensor to generate a signal that a bobbin is not in transit to or from said bobbin stripping station, and wherein said computation means outputs a signal to said bobbin transport only at times when said bobbin transport sensor generates the signal.

13. Apparatus as claimed in claim 12 wherein said computation means evaluates signals from said viewer only when said transport sensor generates the signal that a bobbin is not in transit.

14. Apparatus as claimed in claim 12 wherein said bobbin transport sensor includes a flip-flop set when bobbin stripping is complete so that the completely stripped bobbin may by transported from said bobbin stripping station and reset upon arrival of an unstripped bobbin at said bobbin stripping station.

15. Apparatus as claimed in claim 1 further comprising a rotating transparent shield interposed between said bobbin stripping station and said viewer to centrifugally throw off stripped fiber scattered onto said shield to provide said viewer a clear, shielded view of said apparatus.

16. Apparatus for assuring complete stripping of fibers from a bobbin in a bobbin stripping system comprising a. a bobbin stripping station including oscillating water jets, b. a viewer to view bobbins as they are being stripped at said stripping station and to generate signals representative of a bobbin being stripped, c. a water jet position sensor which generates a signal indicative that the position of said water jets is such that said viewer's view of the bobbin is unobscured, d. an indexing conveyor to move a fully stripped bobbin from said stripping station and to move an unstripped bobbin to said bobbin stripping station, e. a bobbin transport sensor which generates a signal as to whether said indexing conveyor is moving a bobbin to or from said bobbin stripping station, and f. computation means which, when the signals from said water jet position sensor indicate that said viewer's view of the bobbin is unobscured and when said bobbin transport sensor generates a signal that the indexing conveyor is not moving a bobbin:

1) selects pixels of the signals from the viewer,
2) counts a first number of pixels indicative of fibers and a second number of pixels indicative of bobbin,
3) compares the first and second numbers to preset values to determine the amount of fibers still unstripped from a bobbin,
4) generates a signal that the bobbin is fully stripped of fibers when the first number is less than a first preset and the second number exceeds a second preset, and
5) outputs a signal to said indexing conveyor when the bobbin is fully stripped to move the stripped bobbin from said stripping station and to move an unstripped bobbin to said bobbin stripping station.

17. A method of assuring complete stripping of fibers from a bobbin in a bobbin stripping system comprising stripping fibers from a bobbin at a stripping location, viewing a bobbin with a video camera as it is being stripped and generating signals representative of the bobbin being stripped, evaluating the signals to determine the amount of fibers still unstripped from a bobbin, generating a signal indicative that the bobbin is fully stripped of fibers, and transporting a fully stripped bobbin from the stripping location and transporting an unstripped bobbin into the bobbin stripping location in response to said step of generating a signal indicative of the bobbin being fully stripped.

18. A method as claimed in claim 17 wherein said viewing step comprises viewing with a television camera.

19. A method as claimed in claim 17 wherein said evaluating step comprises evaluating the signals in a personal computer.

20. A method claimed in claim 17 wherein said transporting step comprises indexing a conveyor.

21. A method as claimed in claim 17 wherein said bobbin stripping step includes oscillating a water jet and further comprising sensing the position of the water jet and generating a signal indicative that the position of the water jet is such that the view of the bobbin is unobscured by the water jet.

22. A method as claimed in claim 21 wherein said evaluating step occurs when the signals from said water jet position sensing step indicate that said view of the bobbin is unobscured.

23. A method as claimed in claim 17 wherein said evaluating step includes ascertaining and selecting pixels from the signals supplied by said viewing step for evaluation.

24. A method as claimed in claim 23 wherein said evaluating step includes counting a first number of pixels indicative of fibers and a second number of pixels indicative of the bobbin.

25. A method as claimed in claim 24 wherein said evaluating step includes comparing the first and second numbers to preset values and generating the signal that the bobbin is fully stripped when the first number is less than a first preset and the second number exceeds a second preset.

26. A method as claimed in claim 17 wherein said evaluating step includes ascertaining and selecting pixels from the signals supplied by said viewing step for evaluation, counting a number of pixels indicative of fibers, comparing the number to a preset value and generating the signal that the bobbin is fully stripped when the number is less than the preset value.

27. A method as claimed in claim 17 wherein said evaluating step includes ascertaining selecting pixels from the signals supplied by said viewing step for evaluation, counting a number of pixels indicative of bobbin, and comparing the number to a preset value and generating the signal that the bobbin is fully stripped when the number exceeds the preset value.

28. A method as claimed in claim 17 further comprising sensing whether or not a bobbin is in transit to or from the bobbin stripping location, and wherein said evaluating step occurs only at times when the sensing step indicates that a bobbin in not in transit.

29. A method as claimed in claim 17 wherein said viewing step takes place of a viewing location and further comprising rotating a transparent shield between the stripping location and the viewing location to centrifugally throw off fibers scattered onto the shield, to provide a clear, shielded view of the stripping of the bobbin.

30. A method for assuring complete stripping of fibers from a bobbin in a bobbin stripping system comprising.

a. stripping fibers from a bobbin with an oscillating water jet,
b. viewing the bobbins as they are being stripped and generating signals representative of a bobbin being stripped,
c. sensing that the oscillating water jet does not observe the view of the bobbin,
d. moving a fully stripped bobbin from the bobbin stripping location and moving an unstripped bobbin to the bobbin stripping location,
e. sensing whether or not a bobbin is moving to or from the bobbin stripping location, and
f. when the view of the bobbin is unobscured and a bobbin is not moving into or out of the bobbin stripping location:
   1) selecting pixels from the signals from the viewer,
   2) counting a first number of pixels indicative of fibers and a second number of pixels indicative of the bobbin,
   3) comparing the first and second numbers to preset values to determine the amount of fibers still unstripped from a bobbin,
   4) generating a signal that the bobbin is fully stripped of fibers when the first number is less than a first preset and the second number exceeds a second preset, and
g. in response to said generating step, moving the stripped bobbin from the stripping location and moving an unstripped bobbin to the bobbin stripping location.

31. A vision system for automating a process which scatters vision-obscuring by-products comprising a bobbin stripper carrying out the process and scattering vision-obscuring by-products, a viewer directed at said bobbin stripper, control means operatively interposed between said viewer and said bobbin stripper to control said bobbin stripper in response to data received by said viewer about the process being carried out by said bobbin stripper, and a rotating transparent shield interposed between said bobbin stripper and said viewer to centrifugally throw off by-products scattered onto said shield to provide the viewer a clear, shielded view of said bobbin stripper.

32. A system as claimed in claim 31 wherein said viewer is selected from the group consisting of:

a. a television camera, b. a charge coupled device, and c. a photocell.

33. A system as claimed in claim 31 wherein said viewer has a line of sight and said rotating transparent shield comprises a motor mounted to have a driven axis of rotation substantially parallel to said line of sight and a plexiglass disk mounted to said axis of said motor.

34. A vision system for automating a bobbin stripping process comprising a bobbin stripper which scatters fibers and water as vision-obscuring by-products, a television camera with a line of sight directed at said bobbin stripper, control means operatively interposed between said camera and said bobbin stripper to control said bobbin stripper in response to data about the bobbin stripper received by said camera, a motor mounted to have a driven axis of rotation substantially parallel to said line of sight and a plexiglass disk mounted to said axis of said motor to form a rotating transparent shield interposed between said bobbin stripper and said camera to centrifugally throw off fibers and water scattered from said bobbin stripper to provide the camera a clear, shielded view of said bobbin stripper.

35. A method of automating a process of stripping fibers from bobbins with water jets which scatters vision-obscuring by-products comprising carrying out the bobbin stripping process and thereby scattering vision obscuring by-products, viewing the bobbin stripping process from a viewing location as it is carried out, controlling the bobbin stripping process in response to data about the bobbin stripping process received in said viewing step, and rotating a transparent shield between the bobbin stripping process and the viewing location to centrifugally throw off by-products onto the shield, to provide a clear, shielded view of the bobbin stripping process.

36. A method as claimed in claim 35 wherein the viewing location defines a line of sight with the viewed process and said rotating step includes rotating the transparent shield on an axis of rotation substantially parallel to the line of sight.

37. A method for stripping fibers from bobbins comprising stripping fibers from bobbins with water jets and thereby scattering fibers and water as vision-obscuring by-products, viewing the stripping process along a line of sight from a viewing location to generate data, rotating a transparent disk about an axis of rotation generally parallel to the line of sight to centrifugally throw off fibers and water scattered in said bobbin stripping step to provide a clear, shielded view of the bobbin stripping process, and controlling said bobbin stripping step in response to data about said bobbin stripping step generated in said viewing step.

* * * * *

UNITED STATES PATENT AND TRADEMARK OFFICE

CERTIFICATE OF CORRECTION

PATENT NO. : 5,179,769
DATED : January 19, 1993
INVENTOR(S) : John H. Ferguson, Sr. et al.

It is certified that error appears in the above—identified patent and that said Letters Patent is hereby corrected as shown below:

Column 7, line 32 after "complete" insert --stripping--

Signed and Sealed this

Twenty-eighth Day of December, 1993

*Attest:*

Bruce Lehman

BRUCE LEHMAN

*Attesting Officer*

*Commissioner of Patents and Trademarks*